US009950883B2

(12) United States Patent
Hirahara

(10) Patent No.: US 9,950,883 B2
(45) Date of Patent: Apr. 24, 2018

(54) SHEET FEEDING CARTRIDGE AND IMAGE FORMING APPARATUS INCLUDING THE SAME

(71) Applicant: KYOCERA Document Solutions Inc., Osaka (JP)

(72) Inventor: Kazuhisa Hirahara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 2 days.

(21) Appl. No.: 15/310,266

(22) PCT Filed: Jun. 4, 2015

(86) PCT No.: PCT/JP2015/066145
§ 371 (c)(1),
(2) Date: Nov. 10, 2016

(87) PCT Pub. No.: WO2016/013306
PCT Pub. Date: Jan. 28, 2016

(65) Prior Publication Data

US 2017/0247211 A1 Aug. 31, 2017

(30) Foreign Application Priority Data

Jul. 25, 2014 (JP) ..... 2014-151379

(51) Int. Cl.
*B65H 1/26* (2006.01)
*B65H 1/04* (2006.01)
*G03G 15/00* (2006.01)

(52) U.S. Cl.
CPC ..... *B65H 1/266* (2013.01); *B65H 1/04* (2013.01); *G03G 15/6502* (2013.01);
(Continued)

(58) Field of Classification Search
CPC ..... B65H 1/266; B65H 2405/115; B65H 2405/10; B65H 2405/12;
(Continued)

(56) References Cited

U.S. PATENT DOCUMENTS 8,517,374 B2 * 8/2013 Washino ..... B65H 1/266 271/145
9,126,788 B2 * 9/2015 Ishikura ..... B65H 9/08
(Continued)

FOREIGN PATENT DOCUMENTS

JP 07285683 A * 10/1995
JP 2002179256 A * 6/2002
JP 2007-292906 A 11/2007

*Primary Examiner* — Luis A Gonzalez
(74) *Attorney, Agent, or Firm* — Studebaker & Brackett PC

(57) ABSTRACT

A sheet feeding cartridge attached to or detached from a cartridge storing part formed between a pair of side face covers which constitute a part of an exterior cover of an apparatus main body. The sheet feeding cartridge includes a cartridge base on which a sheet is stacked, a cartridge cover attached so as to be slidable in a width direction perpendicular to the attachment direction, a first positioning part configured to position the cartridge base to the cartridge storing part and a second positioning part configured to position the cartridge cover with respect to the side face covers in the width direction perpendicular to the attachment direction.

7 Claims, 9 Drawing Sheets

(52) U.S. Cl.
CPC ..... *B65H 2402/5152* (2013.01); *B65H 2402/5164* (2013.01); *B65H 2801/06* (2013.01)

(58) Field of Classification Search
CPC ..... B65H 2402/5152; B65H 2402/515; B65H 2402/5164; B65H 1/04; G03G 15/6502; G03G 2215/00383
See application file for complete search history.

(56) References Cited

U.S. PATENT DOCUMENTS 9,162,833 B2 * 10/2015 Udagawa ..... B65H 1/266
9,428,353 B2 * 8/2016 Obara ..... G03G 15/6502

* cited by examiner

SHEET FEEDING CARTRIDGE AND IMAGE FORMING APPARATUS INCLUDING THE SAME

TECHNICAL FIELD

The present invention relates to a sheet feeding cartridge configured to be equipped on an image forming apparatus such as a copying machine, a printer, a facsimile machine or a multifunction peripheral which functionally includes them and to store a sheet and an image forming apparatus including the sheet feeding cartridge.

BACKGROUND

Conventionally, an image forming apparatus, such as a copying machine or a printer, is equipped with a sheet feeding cartridge to store a sheet. And, this sheet feeding cartridge is configured to be attachable to or detachable from a cartridge storing part of an apparatus main body. The sheet feeding cartridge has a cartridge base to store the sheet and a cartridge cover. The cartridge cover is fixedly attached on a front side face of the cartridge base by means of mounting screws or the like.

In addition, the conventional sheet feeding cartridge is configured to be positioned with respect to the cartridge storing part by engagement between a guiding rib provided on a side face of the cartridge base and a sliding rail (gap) formed on a side face of the cartridge storing part.

However, since the cartridge cover of the sheet feeding cartridge is molded to have predetermined dimensions with a hard resin material or the like, owing to variation in dimensional precision of the cartridge cover caused by deformation such as warping, alternatively, owing to wobbling caused by engagement failure between the sliding rail and the guiding rib, an attachment position of the sheet feeding cartridge to the cartridge storing part may be shifted. As a result, at the time of attachment of the sheet feeding cartridge, difference in level may be produced between the cartridge cover and an exterior cover (a side face cover) which is adjacent to the cartridge cover, causing problem in design.

Accordingly, in order to solve such kind of problem, for example, Patent Document 1 discloses a sheet feeding cartridge configured such that a guiding part having a rib is extended from the end of the exterior cover and is engaged with a side face of the cartridge cover.

PRIOR ART DOCUMENT

Patent Document

[Patent Document 1] Japanese Patent laid-open Publication No. 2007-292906

SUMMARY OF INVENTION

Problems to be Solved by the Invention

In the invention described in Patent Document 1, at the time of attachment of the sheet feeding cartridge, since the side face of the cartridge cover engages with the end of the exterior cover (the side face cover) while running on the rib of the guiding part, the side face cover and the cartridge cover inserted outside of the end of the side face cover are on the same level each other. Accordingly, the difference in level the side face cover and the cartridge cover can be eliminated.

However, in this case, when the cartridge cover is inserted outside of the end of the side face cover, the cartridge cover is engaged with the end of the side face cover while being forcibly deformed outward by the rib of the guiding part. Thus, a displacement in the attachment position of the sheet feeding cartridge to the cartridge storing part occurs and therefore a displacement in a positional relationship between the sheet stacked on the cartridge base and a sheet feeding roller occurs as well. As the result, a problem such as a conveying failure due to oblique sheet feeding (skew) or the like or a sheet wrinkle may newly occur.

The present invention has been made in view of the circumstance described above, and it is an object of the present invention to provide a sheet feeding cartridge which eliminates difference in level between the cartridge cover and the side face cover at the time of attachment of the sheet feeding cartridge to improve design property and which can be precisely carried out positioning of the attachment position of the sheet feeding cartridge and an image forming apparatus including this sheet feeding cartridge.

Means of Solving the Problems

A sheet feeding cartridge according to the present invention is a sheet feeding cartridge attached to or detached from a cartridge storing part formed between a pair of side face covers which constitute a part of an exterior cover of an apparatus main body. The sheet feeding cartridge includes a cartridge base on which a sheet is stacked, the cartridge base being attachable to or detachable from the cartridge storing part; a cartridge cover attached to a front face of the cartridge base on an upstream side in an attachment direction so as to be slidable in a width direction perpendicular to the attachment direction; a first positioning part configured to position the cartridge base to the cartridge storing part; and a second positioning part configured to position the cartridge cover with respect to the side face covers in the width direction perpendicular to the attachment direction.

Effects of the Invention

By employing such a construction, at the time of attachment of the sheet feeding cartridge, by the first positioning part, the sheet feeding cartridge can be positioned with respect to the cartridge storing part by the first positioning part and a position of the side face plate of the cartridge cover with respect to the end of the side face cover can be sifted depending on sliding of the cartridge cover. Accordingly, it is possible to eliminate the difference in level between the cartridge cover and the side face cover while maintaining an accurate positioning precision of the sheet feeding cartridge with respect to the cartridge storing part.

THE MODE FOR CARRYING OUT THE INVENTION

Hereinafter, with reference to figures, an embodiment of the present disclosure will be described. For convenience of explanation, a direction indicated by each arrow Fr shows a front side.

Figure 1:
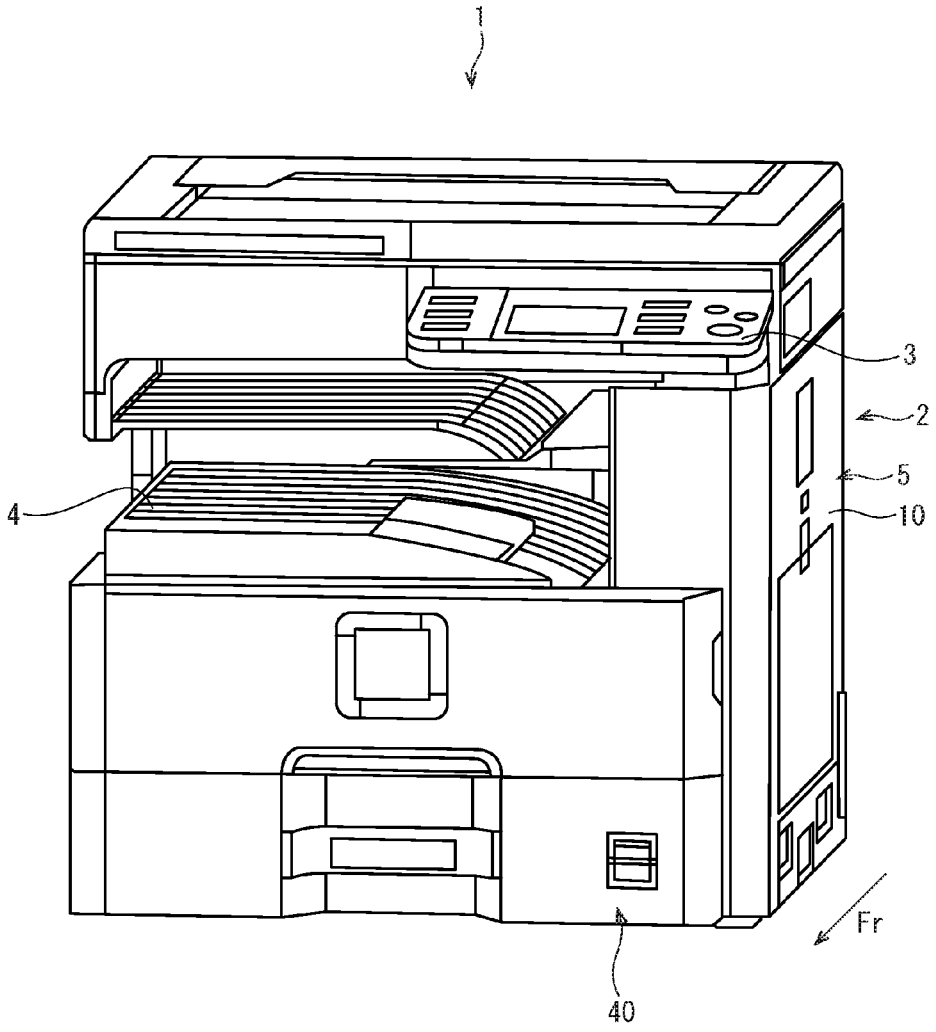
FIG. 1 is a perspective view showing a printer according to an embodiment of the present invention.

First, with reference to FIG. 1 and FIG. 2, a whole configuration of the printer 1 as an image forming apparatus will be described. FIG. 1 is a perspective view showing the printer and FIG. 2 is a schematic view schematically showing an internal structure of the printer.

The printer 1 is constituted by equipping with a substantially box-shaped apparatus main body 2. The apparatus main body 2 is provided with an operating part 3 having an operating button and a display panel and an ejected sheet tray 4 on which a printed sheet is ejected.

The whole of the apparatus main body 2 is covered with an exterior cover 5. On the left and right sides of the apparatus main body 2, a pair of left and right side face covers 10 are provided. In the lower part of the printer 1, a cartridge storing part 30 is formed between the pair of left and right side face covers 10. From front ends of the pair of left and right side face covers 10, guiding parts 10*a* (refer to FIG. 9) is extended. On an exterior face of each guiding part 10*a*, a rib 10*b* is protruded.

Figure 2:
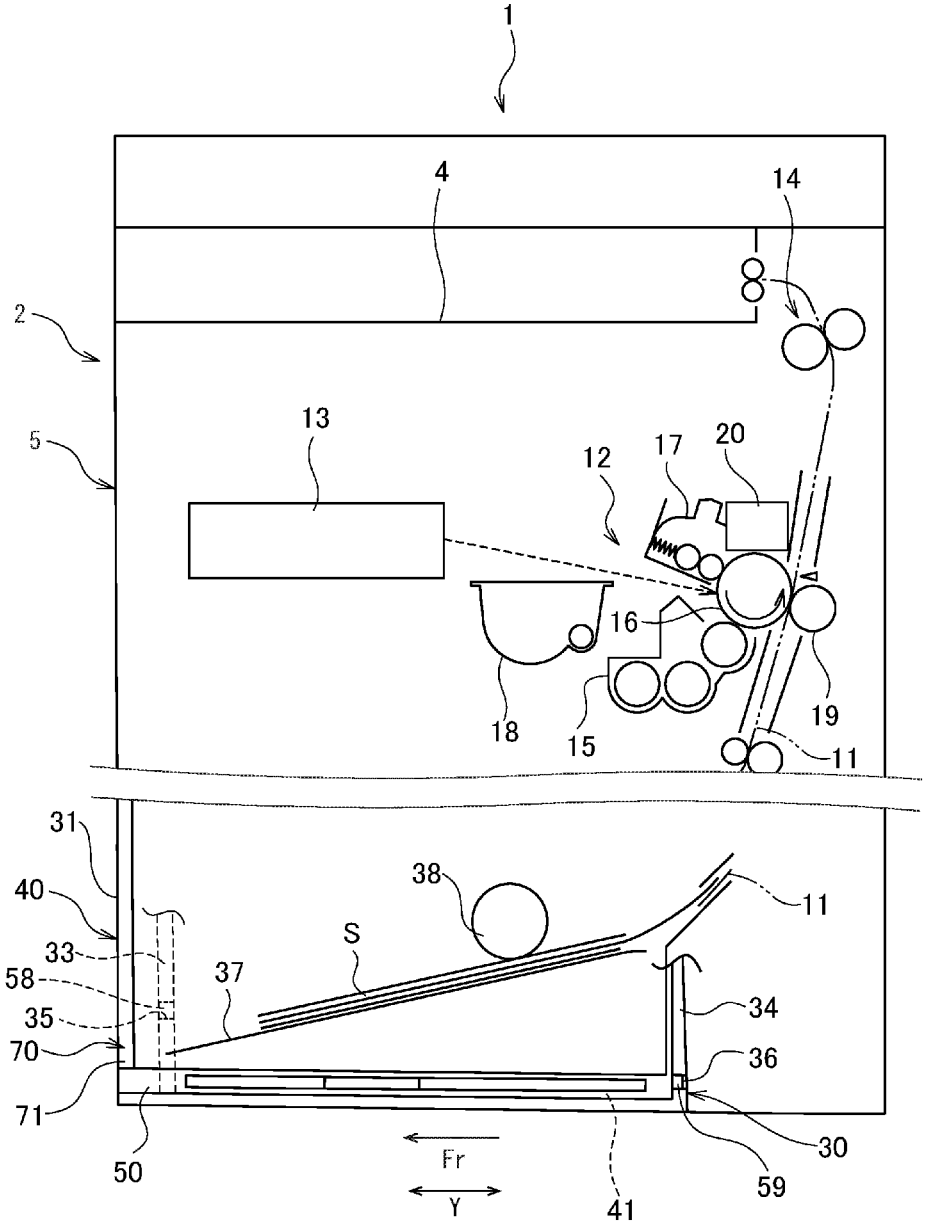
FIG. 2 is a schematic view schematically showing an internal structure of the printer according to the embodiment of the present invention.

As shown in FIG. 2, in the cartridge storing part 30, a front supporting plate 33 and a rear supporting plate 34 are vertically provided on the front and rear ends of the storing base plate 41, respectively. The front supporting plate 33 and the rear supporting plate 34 are respectively formed with fitting holes 35, 36. Into the cartridge storing part 30, a sheet feeding cartridge 40 is attachable and detachable through a front opening 31. A sheet S stored in the sheet feeding cartridge 40 is stacked on an upper face of a sheet stacking plate 37 and pressed by a pressing spring (not shown) provided on an lower face of the sheet stacking plate 37 to comes into contact with a sheet feeding roller 38. Note, although FIG. 2 shows that the sheet S in the sheet feeding cartridge 40 is fed into a conveying path 11 along the same direction as the attachment and detachment directions (a direction shown by an arrow Y in FIG. 2) of the sheet feeding cartridge 40 for convenience of explanation, in the embodiment, the sheet S in the sheet feeding cartridge 40 is practically fed into the conveying path 11 along a direction (a front direction perpendicular to the paper plane) perpendicular to the attachment and detachment directions of the sheet feeding cartridge 40. The sheet S is not limited to a paper sheet such as a plane paper, a high quality paper, a coated paper and a thick paper; includes a various recording medium such as a resin film and a OHP sheet, In the apparatus main body 2, an image forming part 12 which transfers a toner image on the sheet S fed into the conveying path 11 from the sheet feeding cartridge 40, a LSU 13 which irradiates a photosensitive drum 16 with a laser beam and a fixing device 14 which fixes the transferred toner image on the sheet S. The image forming part 12 is constituted by including a toner container 15 which contains replenishment toner, a photosensitive drum 16 as an image carrier, a charger 17 and a development device 18 and a transferring roller 18 and a cleaning device 20 which are disposed along the circumference of the photosensitive drum 16 in the order of transferring process.

The photosensitive drum 16 is formed into a cylindrical shape extending in an axial direction (a depth direction of the paper plane in FIG. 2) and constituted by containing an amorphous silicon photosensitive phase, for example. The photosensitive drum 16 is supported to the inside of the apparatus main body 2 so as to be rotatable around the axis and is operated by a driving motor (not shown) to be rotated in a clockwise direction in FIG. 2.

Next, with reference to FIG. 2, an image forming operation of the printer 1 will be described.

When the printer 1 receives a printing start instruction, the surface of the photosensitive drum 16 charged to predetermined potential by the charger 17 is irradiated with a laser beam (refer to an arrow shown by a dot line in FIG. 2) corresponding to image date by the LSU 13 to forma latent image. The development device 18 develops the latent image into a toner image with the toner supplied from the toner container 15.

On the other hand, the sheet S stacked on the sheet feeding cartridge 40 is fed by the rotation of the sheet feeding roller 38 in the direction (a front direction perpendicular to the paper plane in FIG. 2) perpendicular to the attachment and detachment directions (a direction shown by the arrow Y in FIG. 2) and passed between the photosensitive drum 16 and the transferring roller 19 on the conveying path 11. Then, on the sheet S, the toner image is transferred by the transferring roller 19 which is applied with transferring bias potential. The toner image is fixed on the sheet S by the fixing device 14 and then the sheet S is ejected on the ejected sheet tray 4. The toner remained on the photosensitive drum 16 is collected by the cleaning device 20.

Figure 3:
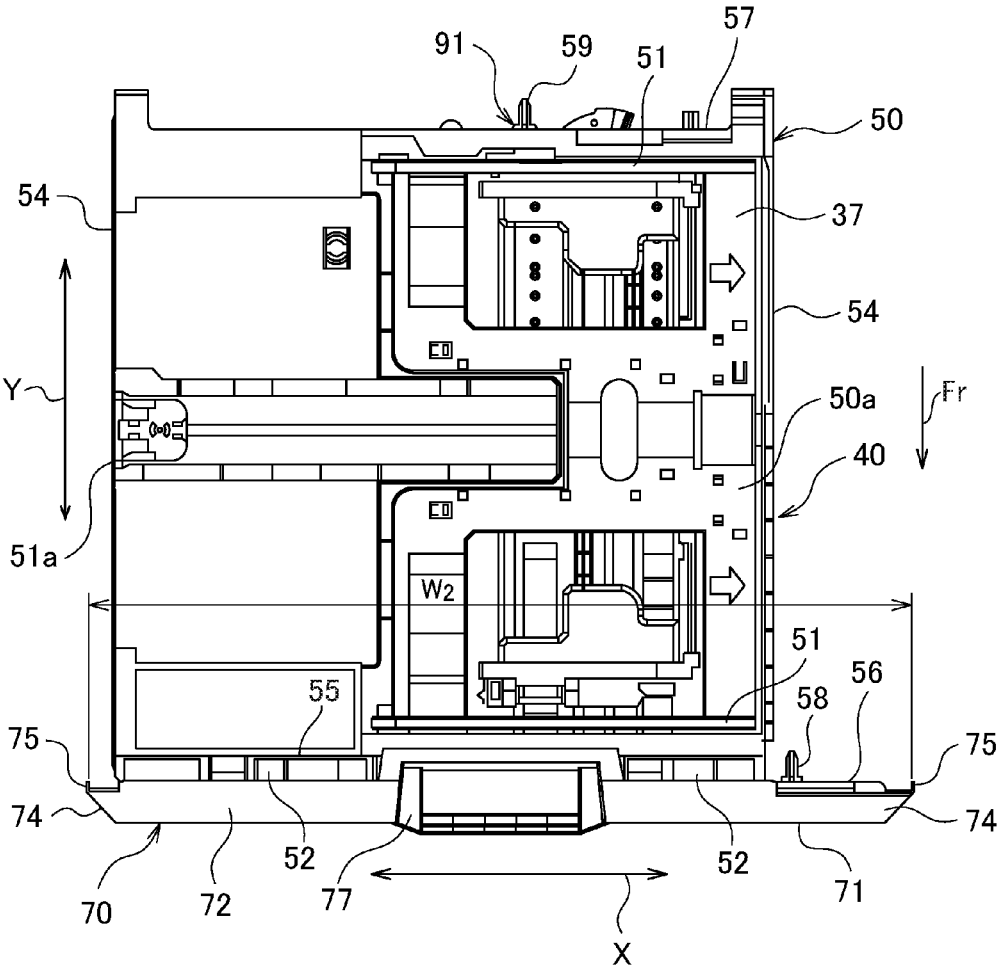
FIG. 3 is a plan view showing a sheet feeding cartridge according to an embodiment of the present invention.
Figure 4:
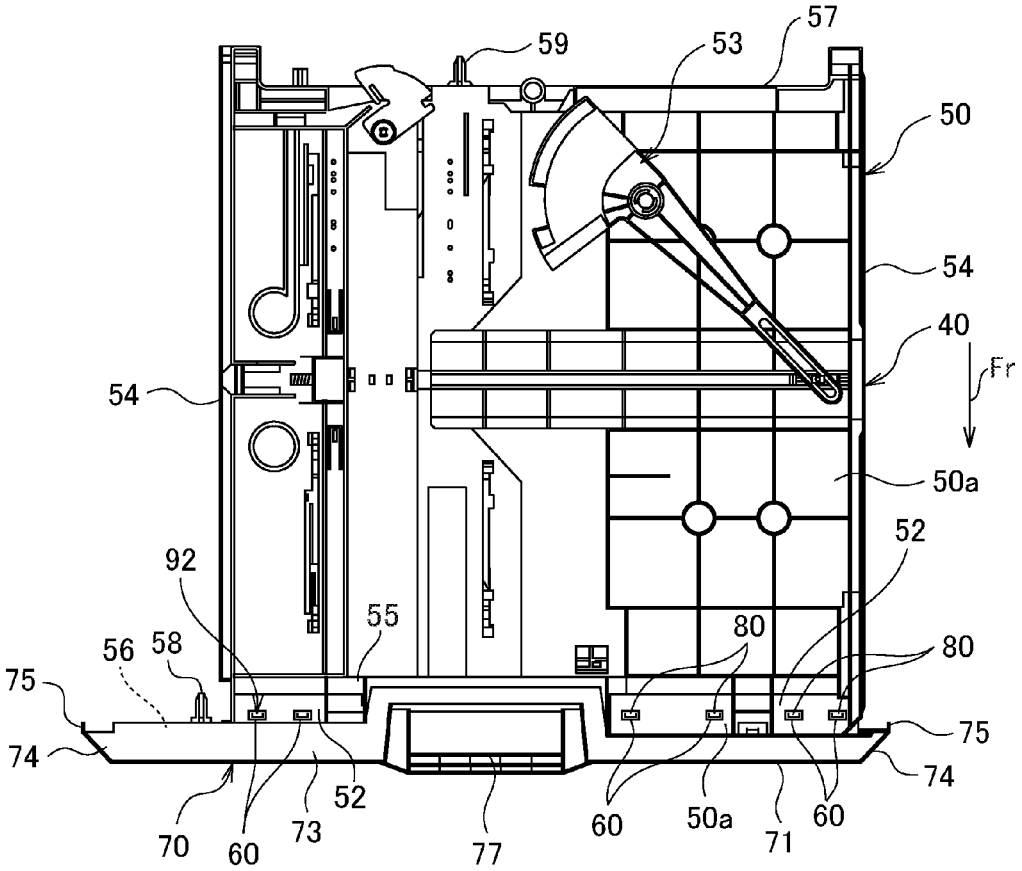
FIG. 4 is a rear view showing the sheet feeding cartridge according to the embodiment of the present invention.
Figure 5:
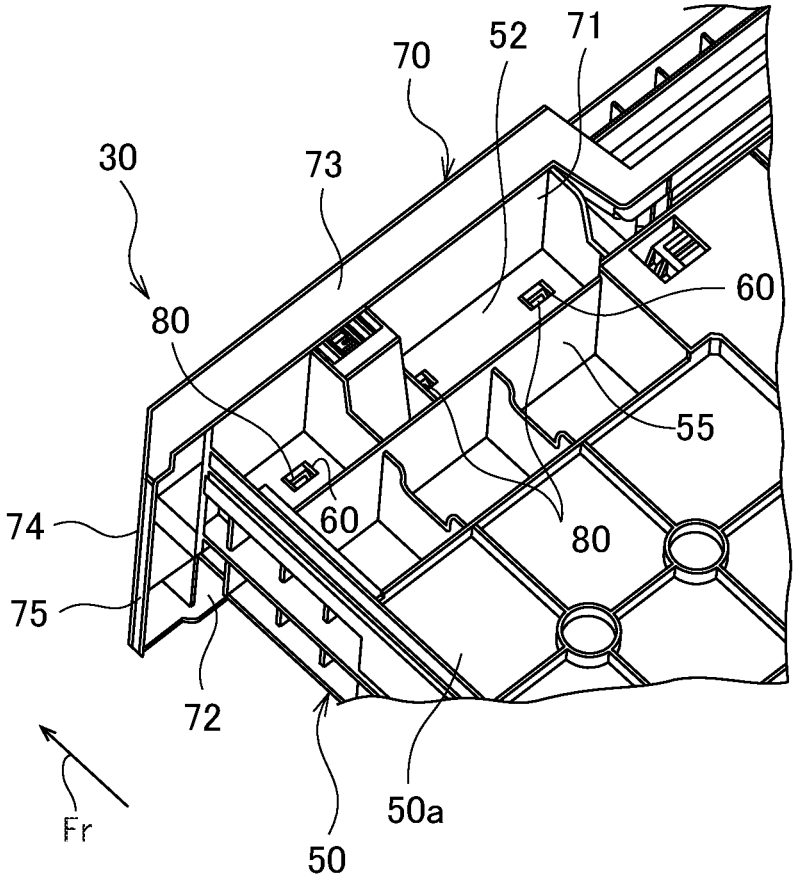
FIG. 5 is a perspective view showing essential parts of FIG. 3 in the sheet feeding cartridge according to the embodiment of the present invention.
Figure 6:
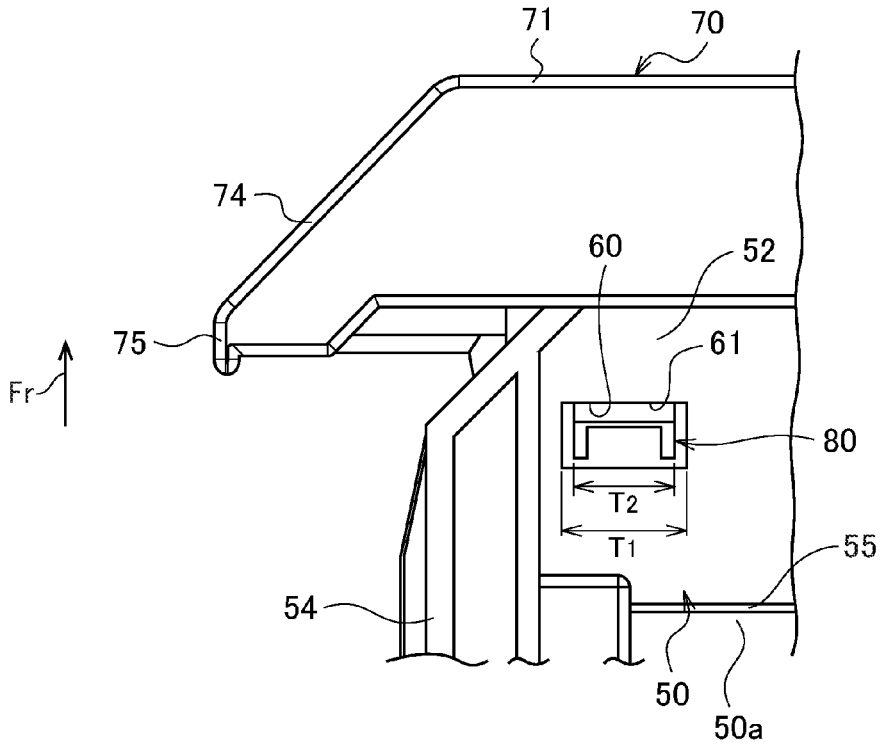
FIG. 6 is a plan view showing the essential parts of FIG. 3 in the sheet feeding cartridge according to the embodiment of the present invention.
Figure 7:
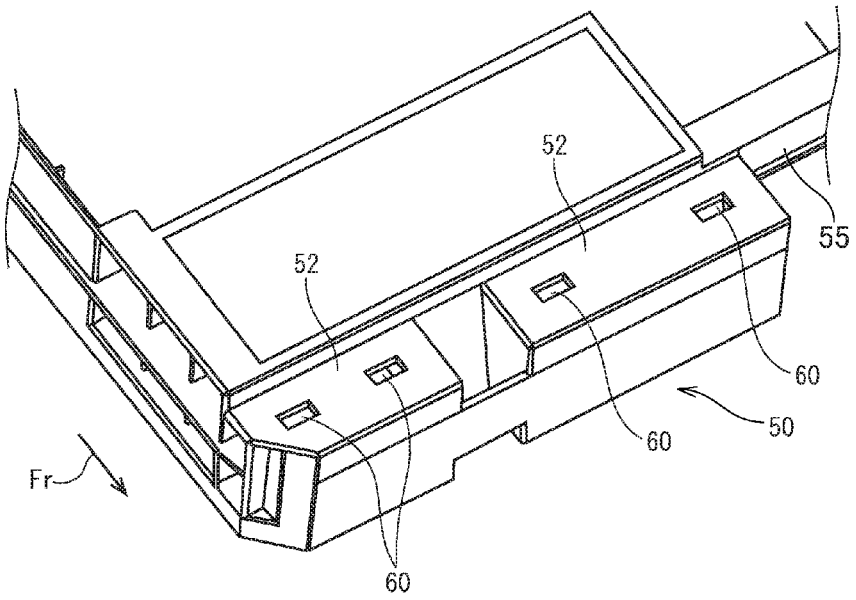
FIG. 7 is a perspective view showing a cartridge base of the sheet feeding cartridge according to the embodiment of the present invention.
Figure 8:
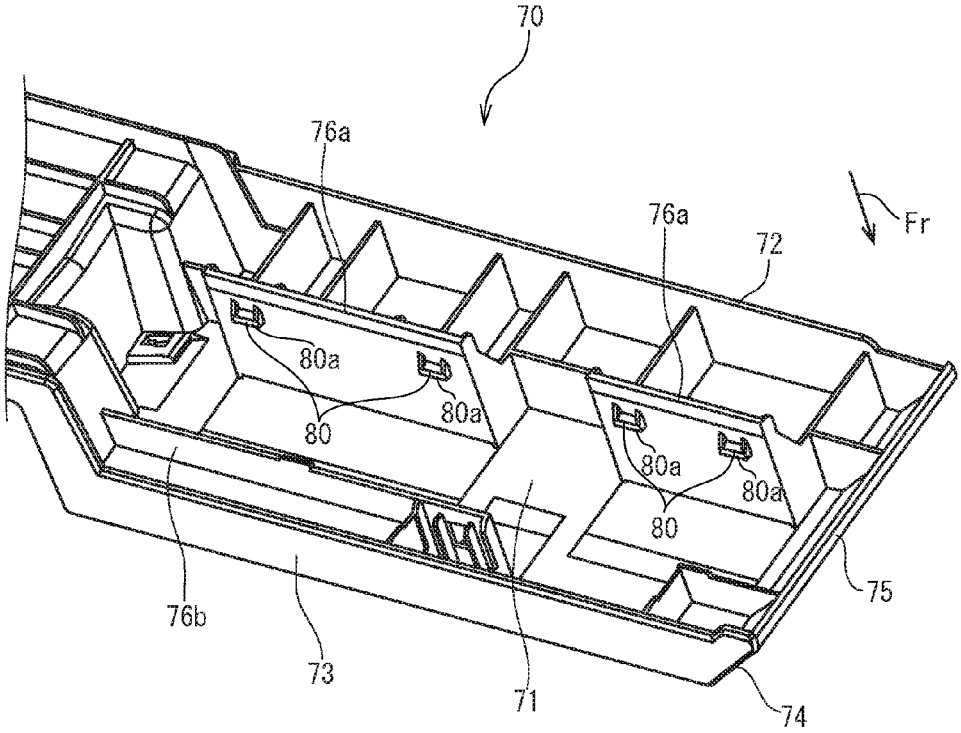
FIG. 8 is a perspective view showing a cartridge cover of the sheet feeding cartridge according to the embodiment of the present invention.
Figure 9:
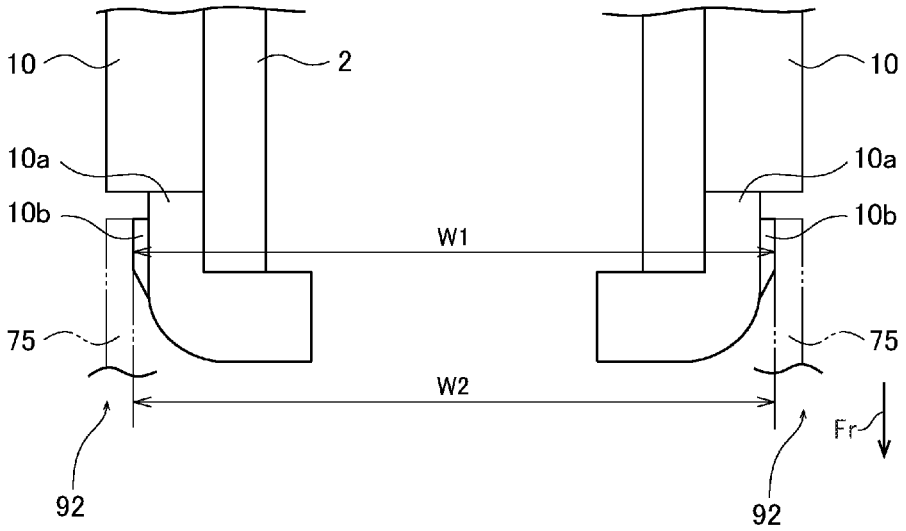
FIG. 9 is an enlarged view showing a vicinity of a guiding part of a side face cover in the sheet feeding cartridge according to the embodiment of the present invention.

Next, with reference to FIG. 3 to FIG. 9, the sheet feeding cartridge 40 according to the embodiment will be described. Here, FIG. 3 is a plan view showing the sheet feeding cartridge 40; FIG. 4 is a rear view showing the sheet feeding cartridge 40; FIG. 5 is a perspective view showing essential parts of FIG. 3; FIG. 6 is a plan view showing the essential parts of FIG. 3; FIG. 7 is a perspective view showing a cartridge base 50 of the sheet feeding cartridge 40; FIG. 8 is a perspective view showing a cartridge cover 70 of the sheet feeding cartridge 40; and FIG. 9 is an enlarged view showing the vicinity of a guiding part of a side face cover 10 of the sheet feeding cartridge 40.

The sheet feeding cartridge 40 has the cartridge base 50 on which the sheet is stacked and the cartridge cover 70 provided on the front side of the cartridge base 50 (the downstream side in the attachment direction of the sheet feeding cartridge 40).

As well shown in FIG. 3 and FIG. 4, the cartridge base 50 is integrally formed by a bottom plate 50*a* entirely formed in a rectangular shape, a front face plate 55 and a rear face plate 57 which are vertically provided at the front and rear ends of the bottom plate 50*a*, respectively, and a pair of base side faces 54, 54 which are vertically provided at the left and right ends of the bottom plate 50*a*, respectively. Also, at the left and right end portions of an outer face of the front face plate 55, front end parts 52 each having an elongated parallelepiped shape are respectively formed. The right front end part 52 is formed with an extension part 56 extending rightward from the right side face. The cartridge base 50 is entirely made of a hard resin material such as an ABS resin material, for example.

In addition, the cartridge base 50 is provided with a pair of side face restricting plates 51 to align the side end of the sheet S for every sheet size and a rear face restricting plate 51*a* to align the rear end of the sheet S for every sheet size. On one side (the right side of FIG. 3) of the cartridge base 50, a sheet stacking plate 37 on which the sheets are stacked is disposed. In addition, on a lower face of the cartridge base 50, a restricting plate adjustment mechanism 53 (refer to FIG. 4) which relatively adjust positions of the pair of side face restricting plates 51 and the rear face restricting plate 51*a* depending on the sheet size is provided.

The extension part 56 and the rear face plate 57 of the cartridge base 50 are respectively formed with a supporting boss 58 and a supporting boss 59 each protruding rearward. The supporting bosses 58, 59 constitute a first positioning part 91. The supporting bosses 58, 59 are positioned so as to be able to be fitted into the fitting holes 35, 36 which are respectively provided on the front supporting plate 33 and the rear supporting plate 34 of the cartridge storing part 30 (refer to FIG. 2). In addition, these supporting bosses 58, 59 each are molded into a snap shape with a hard resin material.

On upper faces of the front end parts 52 of the cartridge base 50, a plurality of (in FIG. 4, six) engaging holes 60 are formed at predetermined intervals. The plurality of engaging holes 60 are positioned so as to be able to be engaged with a plurality of engaging parts 80 protruded from the cartridge cover 70 as described later. As shown in FIG. 6, the engaging hole 60 is formed into a rectangular shape elongated in a width direction perpendicular to the attachment direction of the sheet feeding cartridge 40. A length $T_1$ of this engaging hole 60 in the width direction is set so as to have a dimension ($T_1>T_2$) larger than a length $T_2$ of the engaging part 80 in the width direction.

As shown in FIG. 3 to FIG. 6 and FIG. 8, the cartridge cover 70 is provided with a front plate 71 having an elongated plate shape, a top plate 72 and a bottom plate 73 respectively disposed at the upper and lower ends of the front plate 71 and a pair of side plate 74 which are obliquely disposed at the left and right ends of the top plate 72 and the bottom plate 73. Each side plate 74 is formed with an elastically deformable side plate end part 75 bent at a substantially right angle on the downstream side in the attachment direction from the downstream side end of the front plate 71 in the attachment direction. An interval $W_2$ (refer to FIG. 3 and FIG. 9) between the side plate end parts 75 of the pair of side plates 74, as shown in FIG. 9, is set so as to have a dimension which is equal to or smaller ($W_1 \geq W_2$) than an interval $W_1$ between the guiding parts 10*a* formed with the rib 10*b* of the side plate cover 10. The side plate end parts 75 of the cartridge cover 70 and the guiding parts 10*a* of the side face covers 10 constitute a second positioning part 92. In addition, at an almost central portion of the cartridge cover 70, a grip part 77 (refer to FIG. 3) to be gripped at the time of attaching or detaching operation of the sheet feeding cartridge 40 is integrally formed so as to protrude toward the cartridge base 50. At the time of attachment of the sheet feeding cartridge 40, the cartridge cover 70 functions as an exterior cover to close the opening 31 (refer to FIG. 2) of the cartridge storing part 30.

As well shown in FIG. 8, on a rear side face of the cartridge cover 70 (the face opposing to the front end parts 52 of the cartridge base 50), upper and lower eave parts 76*a*, 76*b* are horizontally protruded in the rear direction (the downstream side direction in the attachment direction) so that the front end parts 52 of the cartridge base 50 are sandwiched between the upper and lower eave parts 76*a*, 76*b*. On a lower face of the upper eave part 76*a*, a plurality of (in FIG. 4, six) engaging parts 80 are provided. The engaging part 80 is made of a hard elastic member capable of a snap-fit coupling. At a tip end of the engaging part 80, an engaging claw 80*a* is formed. By snap-fit engaging the engaging claw 80*a* of the engaging part 80 with the engaging hole 60, the cartridge cover 70 is thereby attached to the cartridge base 50. Thus, since the cartridge cover 70 is attached to or detached from the cartridge base 50 by means of snap-fit coupling, the cartridge cover 70 can be effectively replaced.

In the embodiment provided with such construction, in a case where the sheet feeding cartridge 40 is attached to the cartridge storing part 30 (refer to FIG. 2), positioning of the sheet feeding cartridge 40 with respect to the cartridge storing part 30 is carried out by the first positioning part 91 and positioning of the cartridge cover 70 with respect to the side face covers 10 (refer to FIG. 2) is carried out by the second positioning part 92.

That is, as shown in FIG. 3, when the sheet feeding cartridge 40 is pushed into the cartridge storing part 30 along the attachment or detachment directions (the Y-direction), the supporting bosses 58, 59 respectively protruding from the extension part 56 and the rear face plate 57 of the cartridge base 50 engage with the corresponding engaging holes 35, 36 (refer to FIG. 2) of the front supporting plate 33 and the rear supporting plate 34 so that the sheet feeding cartridge 40 is positioned with respect to the cartridge storing part 30.

When the positioning is thus carried out, a positional relationship between the sheet S stacked on the cartridge base 50 of the sheet feeding cartridge 40 and the sheet feeding roller 38 (refer to FIG. 2) abutting against the sheet S is not varied as well. Accordingly, the sheet S is reliably conveyed along the conveying path 11 (refer to FIG. 2) toward the image forming unit 12 (refer to FIG. 2) without being obliquely fed (skewed) from the sheet feeding roller 38, and an occurrence of a conveyance failure or a sheet wrinkle can be surely prevented.

In addition, at this time, the side plate end parts 75 of the side plates 74 of the cartridge cover 70, as shown in FIG. 9, run on the ribs 10*b* of the guiding parts 10*a* of the side face cover 10 and then are guided along the guiding parts 10*a* of the side face covers 10 while deforming outward, and the cartridge cover 70 slides in the width direction (the X-direction of FIG. 3) perpendicular to the attachment and detachment directions of the sheet feeding cartridge 40.

In a further specific explanation, as described above, since the length $T_1$ of the engaging hole 60 (refer to FIG. 6) formed in the cartridge base 50 in the width direction is set to have a dimension ($T_1>T_2$) larger than the length $T_2$ of the engaging part 80 in the width direction, at the time of engagement of the engaging part 80 with the engaging hole 60, a predetermined gap is formed between the side faces of the engaging hole 60 and the side faces of the engaging part 80. Accordingly, when the sheet feeding cartridge 40 is attached, the cartridge cover 70 slides in the width direction (the X-direction of FIG. 3) with respect to the cartridge base 50, and the engagement position of the engaging part 80 of the cartridge cover 70 with the engaging hole 60 of the cartridge base 50 is shifted with the sliding of the cartridge cover 70. Therefore, when the sheet feeding cartridge 40 is attached, the end of the side face cover 10 is opposed to the end of the side plate end 75 shifted with the sliding of the cartridge cover 70 to each other in the attachment direction and there is no difference in level between the end of the side face cover 10 and the end of the side plate end 75. In other words, the side faces of the side face covers 10 and the side face of the cartridge cover 70 are on the same level. In addition, the engaging part 80 engages with the engaging hole 60 so that the cartridge cover 70 is positioned on the cartridge base 50 in the attachment direction.

Therefore, with the sheet feeding cartridge 40 according to the embodiment of the present invention described above, it is possible to prevent a surface difference between the cartridge cover 70 and the side face covers 10 while holding an accurate positioning precision of the sheet feeding cartridge 40 with respect to the cartridge storing part 30, and design property can be improved.

Although the engaging part is engaged by a snap-fit engaging in the embodiment of the present invention described above, a stepped screw may be employed in place of the snap-fit engaging. In this case also, it is possible to slide the cartridge cover 70 at the time of attachment of the sheet feeding cartridge 40 so that the side faces of the side face covers 10 and the side face of the side plate end part 75 shifted with the sliding of the cartridge cover 70 can be on the same level.

While the preferable embodiment and its modified example of the sheet feeding device and the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

The invention claimed is:

1. A sheet feeding cartridge attached to or detached from a cartridge storing part formed between a pair of side face covers which constitute a part of an exterior cover of an apparatus main body, the sheet feeding cartridge comprising:

a cartridge base on which a sheet is stacked, the cartridge base being attachable to or detachable from the cartridge storing part;

a cartridge cover attached to a front face plate of the cartridge base on an upstream side in an attachment direction so as to be slidable in a width direction perpendicular to the attachment direction;

a first positioning part configured to position the cartridge base to the cartridge storing part; and a second positioning part configured to position the cartridge cover with respect to the side face covers in the width direction, wherein the first positioning part includes:

a protruding part provided on the front face plate of the cartridge base and protruding in the attachment direction; and a recessed part into which the protruding part is fitted and which is provided on an attaching face of the cartridge storing part, the attaching face opposing to the front face plate in the attachment direction, the second positioning part has:

a pair of side plate end parts being elastically deformable and extending on the downstream side in the attachment direction from both ends in the width direction of the cartridge cover; and guiding parts extending inside of the pair of side plate end parts from upstream side ends of the pair of side face covers in the attachment direction, and wherein when the cartridge base is attached to the cartridge storing part, the protruding part is fitted into the recessed part so as to position the cartridge base to the cartridge storing part and the side plate end parts of the cartridge cover are guided by the guiding parts of the side face covers while being elastically deformed and the cartridge cover is slid with respect to the front face plate so that the cartridge cover is positioned to the side face covers with ends of the side face covers opposing ends of the cartridge cover to each other in the attachment direction so as to eliminate difference in level between the ends of the side face covers and the ends of the cartridge cover.

2. The sheet feeding cartridge according to claim 1, wherein an engaging part is provided on either one of a front end part provided on the cartridge base on the upstream side in the attachment direction and an eave part provided on the cartridge cover protruding toward the front end part from a face opposing to the front end part, an engaged part is provided on the other of the front end part and the eave part so as to be slidably engaged with the engaging part only in the width direction and the cartridge cover is positioned to the cartridge base in the attachment direction and attached to be slidable in the width direction by the engagement of the engaging part with the engaged part.

3. The sheet feeding cartridge according to claim 2, wherein the engaging part is provided with an engaging claw at the tip end thereof, and engaged part is a slit extending along the width direction and a length of the slit in the width direction is set to be larger than a length of the engaging part in the width direction.

4. The sheet feeding cartridge according to claim 2, wherein the engaging part engages with the engaged part by means of snap-fit coupling.

5. The sheet feeding cartridge according to claim 2, wherein a plurality of the engaging parts and a plurality of the engaged parts are formed along the width direction.

6. The sheet feeding cartridge according to claim 2, wherein the eave part is configured to sandwich the front end part from an upper side and a lower side of the front end part.

7. An image forming apparatus comprising the sheet feeding cartridge according to claim 1.

* * * * *